US010029171B1

(12) United States Patent
Lando

(10) Patent No.: US 10,029,171 B1
(45) Date of Patent: Jul. 24, 2018

(54) 2X2X2 CUBE PUZZLE AND A CUBE STAND

(71) Applicant: Mordechai Lando, Beer-Sheva (IL)

(72) Inventor: Mordechai Lando, Beer-Sheva (IL)

( * ) Notice: Subject to any disclaimer, the term of this patent is extended or adjusted under 35 U.S.C. 154(b) by 0 days.

(21) Appl. No.: 15/413,739

(22) Filed: Jan. 24, 2017

(51) Int. Cl.
*A63F 9/12* (2006.01)

(52) U.S. Cl.
CPC ..... *A63F 9/12* (2013.01); *A63F 2009/1296* (2013.01)

(58) Field of Classification Search
CPC .. A63F 9/12; A63F 2009/1292; A63F 9/1288; A63F 9/1204
See application file for complete search history.

(56) References Cited

U.S. PATENT DOCUMENTS 1,866,117 A * 7/1932 Logan ..... A47F 5/114 211/133.1
2,886,325 A * 5/1959 Long ..... A63F 3/00214 273/157 R
3,771,795 A * 11/1973 Flanigen ..... A63F 9/12 206/315.1
3,930,651 A * 1/1976 Rader ..... A63F 9/0098 273/156
4,009,882 A * 3/1977 Rader ..... A63F 9/0098 273/156
4,037,846 A * 7/1977 Zeeman ..... A63F 9/12 273/157 R
D252,966 S * 9/1979 Cohen ..... D6/407
4,210,332 A * 7/1980 Shanin ..... A63F 9/12 273/157 R
4,257,609 A * 3/1981 Squibbs ..... A63F 9/1204 273/157 A
4,308,016 A * 12/1981 White ..... G09B 19/00 273/157 R
4,574,960 A * 3/1986 Shikatani ..... A47F 5/00 211/189
5,711,524 A * 1/1998 Bauer ..... A63F 3/00574 273/153 P
6,209,720 B1 * 4/2001 Chen ..... B65D 25/10 206/315.1
7,140,612 B2 * 11/2006 Chen ..... A63F 9/12 273/156
7,731,192 B1 * 6/2010 Marhefka ..... A63F 9/06 273/156
9,162,139 B2 10/2015 Lando

* cited by examiner

*Primary Examiner* — Steven Wong

(57) ABSTRACT

A cube packing comprises two truncated pyramids configured for a packing mode and a stand mode. In the packing mode, each pyramid touches three faces. In the stand mode, a first pyramid lays on a substantially horizontal surface, a second pyramid rests on the first pyramid and a large cube resides in the second pyramid while having a vertex pointing upwards. The large cube consists of eight small cubes, which in turn consist of a first group of eight pieces and a second group of 16 pieces. Each small cube includes one piece of the first group and two pieces of the second group. The eight pieces of the first group include at least three pieces different from each other at least by color, and may include at least three pieces different from each other at least by shape. In addition, the 16 pieces of the second group include at least three pieces different from each other at least by shape, and may include at least three pieces different from each other at least by color. Each small cube consists 3×3×3 mini-cubes by volume.

7 Claims, 11 Drawing Sheets

| | | |
|---|---|---|
| 5o* blue | 5o* brown | 5o* green |
| 52* blue | 52* brown | 52* green |
| 54* blue | 54* brown | 54* green |

← 71

Fig. 7a

| | | |
|---|---|---|
| 50 yellow | 50 white | 50 orange |
| 52 yellow | 52 white | 52 orange |
| 54 yellow | 54 white | 54 orange |

← 73

| | | |
|---|---|---|
| 50 yellow | 50 white | 50 orange |
| 52 yellow | 52 white | 52 orange |
| 54 yellow | 54 white | 54 orange |

← 75

Fig. 7b

| | | |
|---|---|---|
| 5o* blue | 5o* brown | 5o* green |
| 52* blue | 52* brown | 52* green |
| 54* blue | | 54* green |

← 81

Fig. 8a

| | | |
|---|---|---|
| 50 yellow | 50 white | 50 orange |
| 52 yellow | 52 white | |
| 54 yellow | 54 white | 54 orange |

← 83

| | | |
|---|---|---|
| | 50 white | 50 orange |
| 52 yellow | 52 white | 52 orange |
| 54 yellow | 54 white | 54 orange |

← 85

Fig. 8b

91

| Cube number | First group | Second group | |
|---|---|---|---|
| 41 | 5o* blue | 52 yellow | 54 orange |
| 42 | 52* blue | 50 white | 54 orange |
| 43 | 54* blue | 50 yellow | 52 white |
| 44 | 5o* brown | 54 yellow | 52 orange |
| 45 | 52* brown | 50 orange | 54 white |
| 46 | 5o* green | 52 white | 54 yellow |
| 47 | 52* green | 50 orange | 54 white |
| 48 | 54* green | 50 white | 52 yellow |

Fig. 9a

92

| Cube number | First group | Second group | |
|---|---|---|---|
| 41 | 5o* blue | 52 yellow | 54 orange |
| 42 | 52* blue | 50 white | 54 orange |
| 43 | 54* blue | 50 yellow | 52 yellow |
| 44 | 5o* brown | 54 yellow | 52 orange |
| 45 | 52* brown | 50 orange | 54 white |
| 46 | 5o* green | 52 white | 54 yellow |
| 47 | 52* green | 50 orange | 54 white |
| 48 | 54* green | 50 white | 52 white |

Fig. 9b

2X2X2 CUBE PUZZLE AND A CUBE STAND

THE FIELD OF INVENTION

The invention is in the field of indoor games, and in particular in the field of puzzles, including three-dimensional combination puzzles or jigsaw games.

THE PRIOR ART

Several cube puzzles were invented in the $20^{th}$ century and gained substantial popularity in the toy market. Three of them are highly relevant to the puzzle of the present disclosure. The first is the Soma Cube, described in Wikipedia as follows: "The Soma Cube is a solid dissection puzzle invented by Piet Hein in 1936 during a lecture on quantum mechanics conducted by Werner Heisenberg. Seven pieces made out of unit cubes must be assembled into a 3×3×3 cube."

The second cube puzzle is the Hungarian cube or Rubik's cube which is widely considered to be the best selling toy ever.

The third cube puzzle is Lando Cubes game which was invented by the present inventor, and for which an Israeli Patent No. 174729 and a U.S. Pat. No. 9,162,139 to M. Lando had been granted. The game includes three cubes consisting of nine pieces, and is sold in toy shops and in a variety of online stores. As it includes only three cubes, it falls short of forming a single large cube, and it resembles the other cube puzzles only to a limited extent.

The present disclosure uses the building blocks of Lando Cubes to form a large cube which comprises 2×2×2 small cubes, to pack the large cube efficiently and to pose it for an exhibition in an innovative way. Thus, the present toy stands in line with the prior art cube puzzles. However, it provides absolutely different user experience and challenge.

BRIEF DESCRIPTION OF THE INVENTION

It is provided a cube packing which includes two separate packing members. The cube packing is configured for use in two non-simultaneous functional modes. In a packing mode, each packing member touches two to four faces of a cube, such that together they touch at least six faces of the cube. In a stand mode, a first packing member lays on a substantially horizontal surface, a second packing member rests on the first packing member, and the cube resides in the second packing member while having a vertex pointing upwards.

In one embodiment, the cube packing includes at least one triangular pyramid which has no base and at least three of its four vertices are truncated. Preferably, the two packing members are triangular pyramids and each one has four truncated vertices. More preferably, each truncated pyramidal packing member has one flat elongated surface configured for parallel interfacing with the substantially horizontal surface in the stand mode. Possibly, each truncated pyramidal packing member has one flat surface for parallel interfacing with a flat surface of the other truncated pyramidal packing member in the stand mode.

In one embodiment, the cube packing is used for a Suma Cube or for a Rubik's Cube™.

It is provided in accordance with a preferred embodiment of the current disclosure, a puzzle game which includes the above cube packing, and a large cube packable there within. The large cube consists of eight small cubes of a common size. The eight small cubes consist of a first group of eight pieces and a second group of 16 pieces. Each small cube includes one piece of the first group and two pieces of the second group. There is no way to assemble a small cube using only pieces of the first group, or using only pieces of the second group.

Note that a cube, large or small, has no substantial apparent vacancy within its cubic boundaries.

In one embodiment, in the packing mode, the two packing members block exit out of the large cube of any piece.

In one embodiment, the eight pieces of the first group include at least three pieces different from each other at least by color, and may include at least three pieces different from each other at least by shape. In addition, the 16 pieces of the second group may include at least three pieces different from each other at least by shape, and may include at least three pieces different from each other at least by color.

In one embodiment, each of the pieces of the first group is different from another piece thereof at least by a shape or by a color.

In one embodiment, each small cube includes three pieces different by shape. Also, at least five small cubes have three pieces at three different colors.

In one embodiment, each small cube consists 3×3×3 mini-cubes by volume, whereas each piece of the first group and each piece of the second group exhibits at least one side of a mini-cube. Preferably, the number of mini-cubes in a piece of the first group is 9, 11 or 13, and the number of mini-cubes in a piece of the second group is 6, 8 or 10.

In one embodiment, the second group includes at least seven pairs of pieces, the pieces of each pair are identical to each other by both shape and color. In contrast, in the second group, there are no triplet of pieces identical to each other by both shape and color.

BRIEF DESCRIPTION OF THE DRAWINGS

The invention is herein described, by way of example only, with reference to the accompanying drawings, which illustrate several preferred embodiments of the invention.

FIG. 7*a* is a table listing candidate pieces for a first group of eight pieces.

FIG. 7*b* shows two tables listing candidate pieces for a second group of 16 pieces.

FIG. 8*a* is a table listing exactly eight pieces selected for a first group of pieces.

FIG. 8*b* shows two tables listing exactly 16 pieces selected for a second group of pieces.

FIG. 9*a* is a table of 24 pieces assembled into the eight small cubes.

FIG. 9*b* is an alternative table of 24 pieces assembled into the eight small cubes.

DESCRIPTION OF PREFERRED EMBODIMENTS

Figure 1:
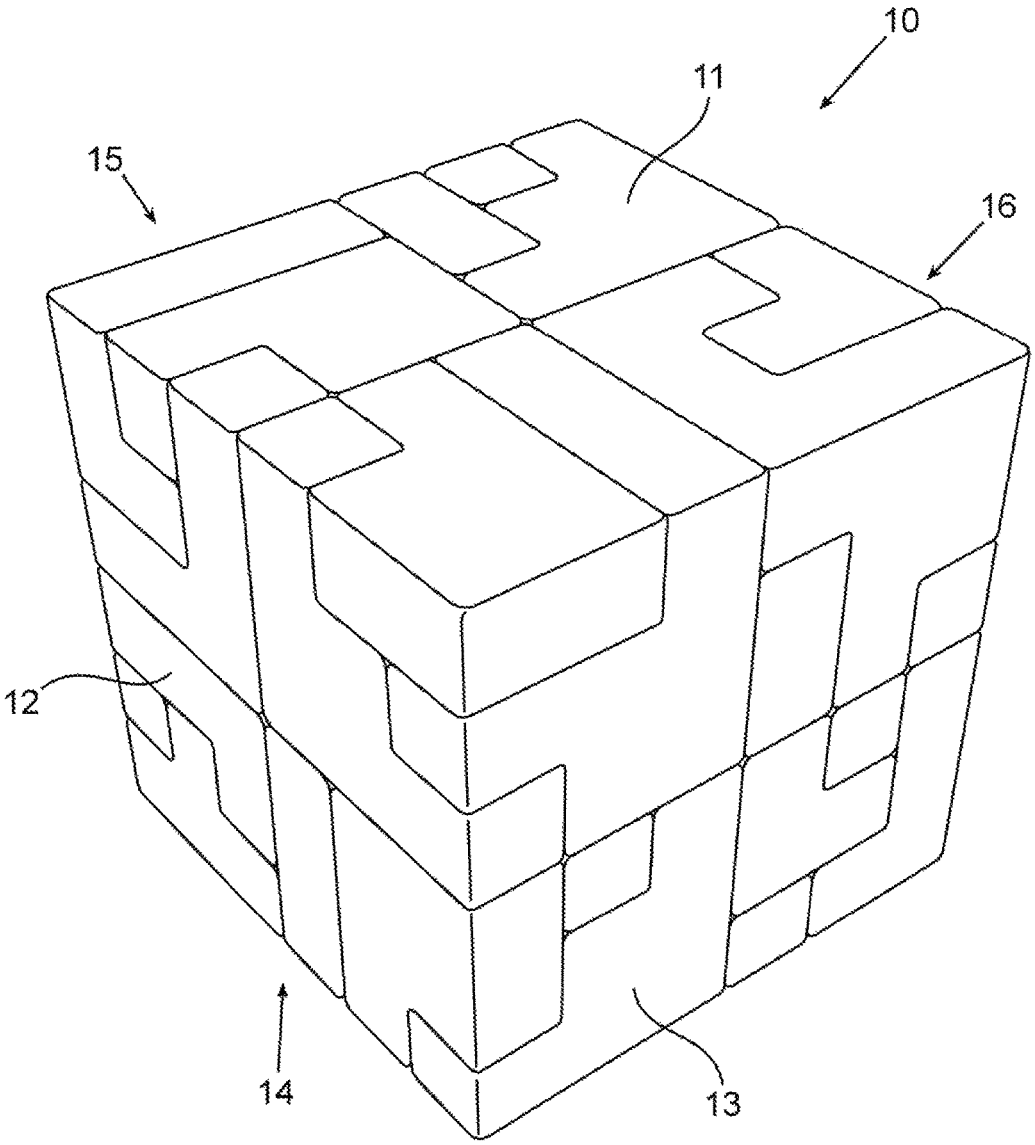
FIG. 1 depicts a large cube having six faces.

The present invention will now be described in terms of specific example embodiments. It is to be understood that the invention is not limited to the example embodiments disclosed. It should also be understood that not every feature of puzzle game is necessary to implement the invention as claimed in any particular one of the appended claims. Various elements and features are described to fully enable the invention.

Before explaining embodiments of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Unless otherwise defined, all technical and scientific terms used herein have the same meaning as commonly understood by one of ordinary skill in the art to which this invention belongs. The materials, methods, and examples provided herein are illustrative only and not intended to be limiting.

In the description and claims of the present application, each of the verbs "comprise", "include" and "have", and conjugates thereof, are used to indicate that the object or objects of the verb are not necessarily a complete listing of members, components, elements or parts of the subject or subjects of the verb.

Along the following disclosure, a cube means a full cube that has no substantial apparent vacancy within its cubic boundaries.

A Cube Packing (FIGS. 1-4)

FIG. 1 depicts an exemplary cube 10. Faces 11, 12 and 13 of cube 10 are shown in FIG. 1, while faces 14, 15 and 16 are hidden. A cube packing for a cube like exemplary cube 10 includes two packing members which might be different from each other. In a preferred embodiment, the two packing members are identical, at least by shape.

Figure 2A:
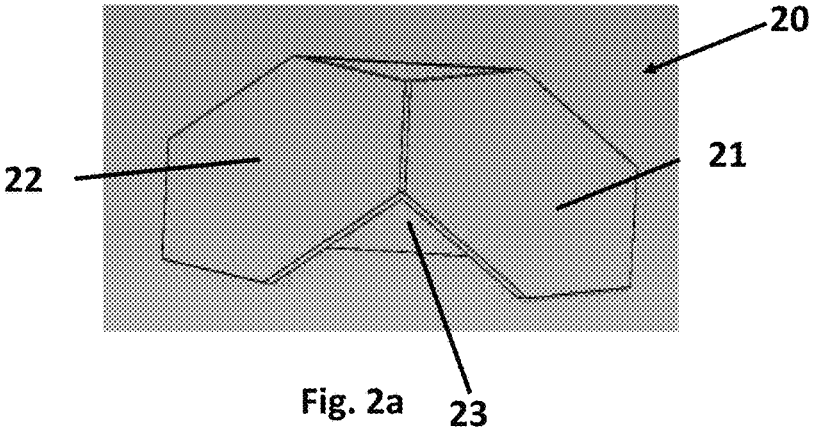
FIG. 2*a* is a side view of a truncated triangular pyramid for use as one of two packing members of a cube packing.
Figure 2B:
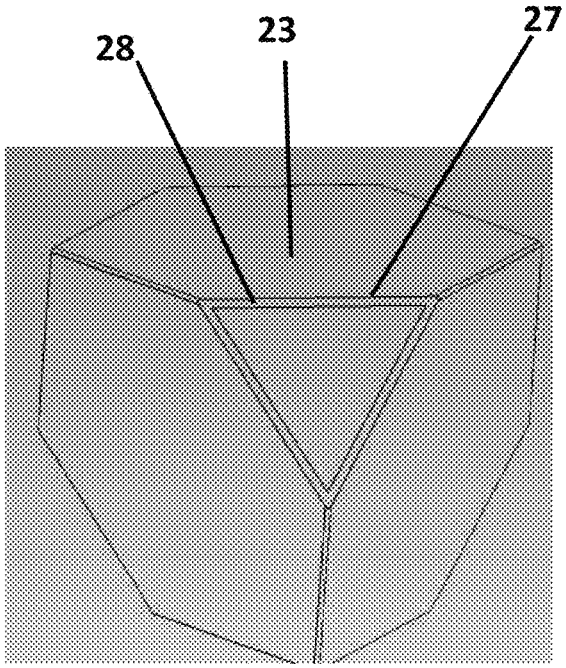
FIG. 2*b* is a top view of the truncated triangular pyramid of FIG. 2*a*, showing a top truncated vertex cut such as to have a flat triangular surface.
Figure 2C:
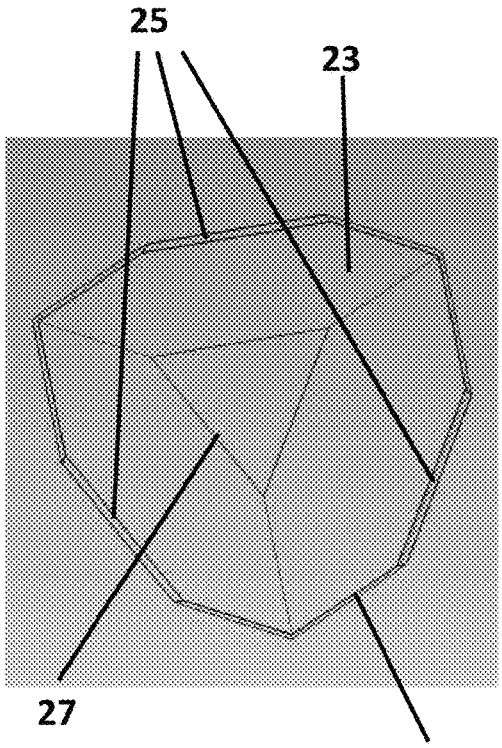
FIG. 2*c* is a bottom view of the truncated triangular pyramid of FIG. 2*a*, showing three truncated side vertices, one top truncated vertex and three elongated flat surfaces.

An exemplary truncated triangular pyramid 20 for use as one of the two packing members is shown in FIGS. 2*a*, 2*b*, and 2*c*. FIG. 2*a* is a side view of the truncated triangular pyramid 20, showing its three hexagonal sides 21, 22 and 23 which are rectangular to each other such as to touch three faces of a cube.

FIG. 2*b* is a top view of the truncated triangular pyramid 20, showing a triangular cut 27 of a top truncated vertex and a flat triangular surface 28, which is further discussed below.

FIG. 2*c* is a base view of the truncated triangular pyramid 20, having three truncated side vertices, cut along 29 for example, the truncated cut 27 of the top truncated vertex and three elongated flat surfaces 25, which are further discussed below.

The cube packing is used in two non-simultaneous functional modes. A packing mode is described in FIGS. 3*a*, 3*b* and 3*c*. A stand mode is described in FIGS. 4*a*, 4*b* and 4*c*.

Figure 3A:
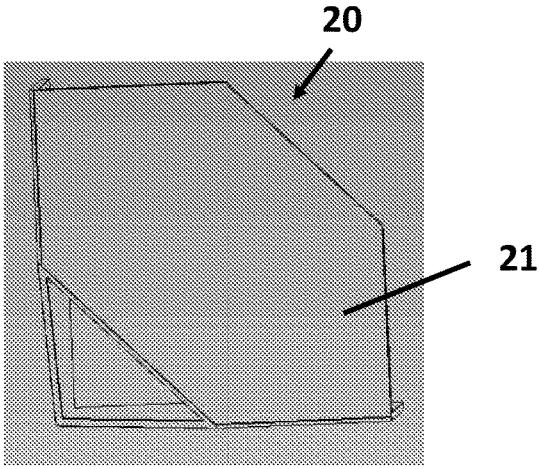
FIG. 3*a* is a view of a first truncated triangular pyramid in a packing mode, posed such as to touch three faces of the large cube.
Figure 3B:
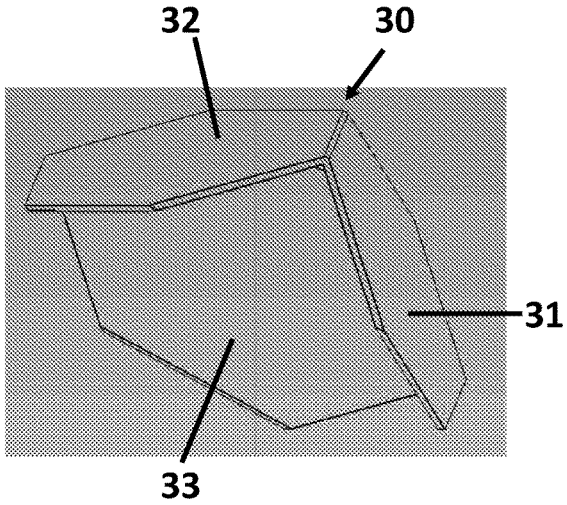
FIG. 3*b* is a view of a second truncated triangular pyramid in the packing mode, posed such as to touch the remaining three faces of the large cube.
Figure 3C:
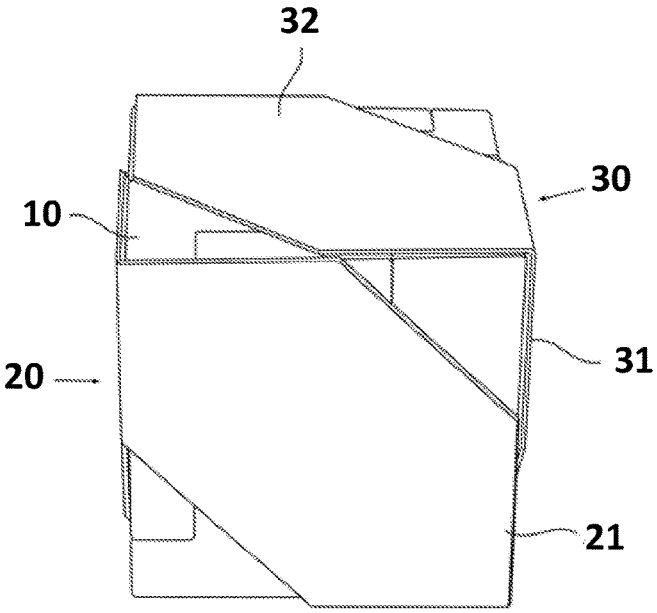
FIG. 3*c* shows the packing mode, whereas the large cube of FIG. 1 is packed within the first and second truncated triangular pyramids.

FIG. 3*a* is a view of the truncated triangular pyramid 20 posed such as to touch three sides of the cube 10. FIG. 3*b* is a view of a truncated triangular pyramid 30 posed such as to touch the remaining three sides of the cube 10 by its respective hexagonal sides 31, 32 and 33. FIG. 3*c* shows the cube 10 packed within the truncated triangular pyramids 20 and 30 in the packing mode, whereas each pyramid touches three faces of the cube 10, such that together they touch all six faces or sides of the cube 10. More specifically, FIG. 3*c*, shows side 21 of pyramid 20 and sides 31 and 32 of pyramid 30 covering or touching three faces of the cube 10. The remaining cube faces of the cube 10 (not shown) are touched by sides 22 and 23 of pyramid 20 and by side 33 of pyramid 30.

Figure 4A:
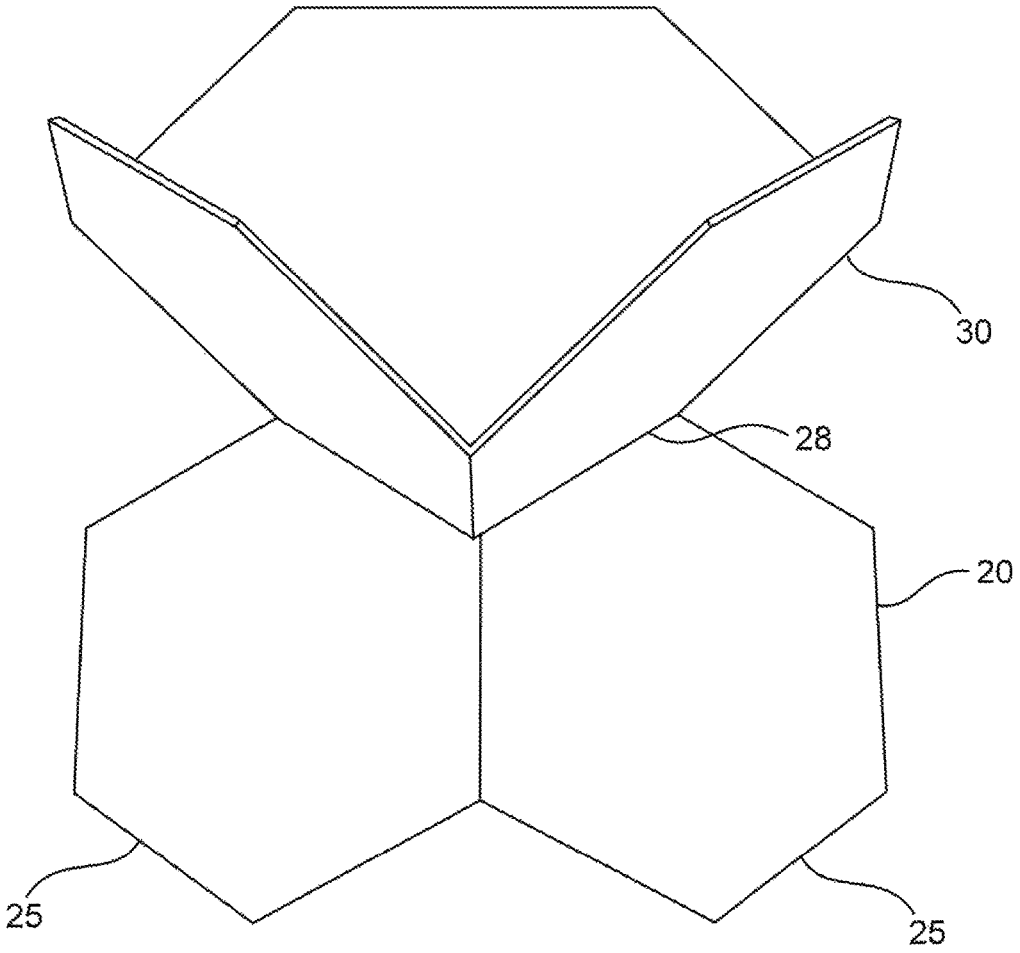
FIG. 4*a* is a perspective view of the stand mode, showing a truncated triangular pyramid resting on another truncated triangular pyramid.

FIG. 4*a* is a perspective view of the pyramid 30 resting on the pyramid 20 in a stand mode. Pyramid 20 lays on a substantially horizontal surface 45, whereas the three elongated flat surfaces 25 of pyramid 20 parallel surface 45 and thus touch it across their flat areas. The pyramids 20 and 30 interface each other across their respective flat surfaces 28 which are also parallel to surfaces 25 and 45.

Figure 4B:
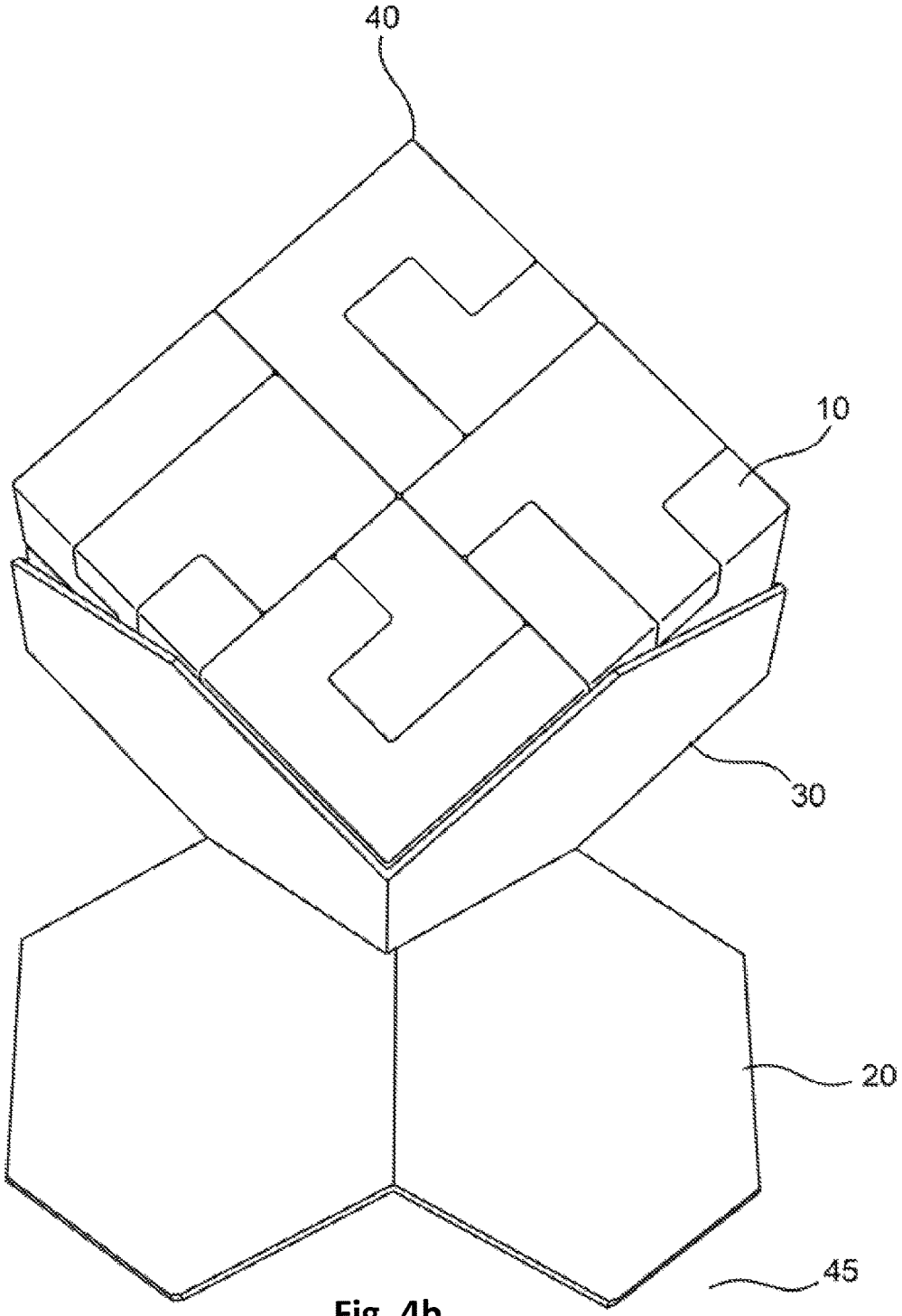
FIG. 4*b* is a perspective view of the of the stand mode, showing large cube positioned on the truncated triangular pyramid which rests on the other truncated triangular pyramid.

FIG. 4*b* is a perspective view of the cube 10 positioned on the pyramid 30. Its vertex 40 points upwards.

The currently disclosed cube packing has been developed for use of the cube 10 (hereafter the large cube) which is fully described below. However, the cube packing may be used also for other cubes known in the art of toys s well as by cubes in any other art, consumer electronics for example. In special, the cube packing may be used for Soma Cube and Rubik's Cube™, mentioned in the prior art section.

The pyramids may be made of cardboard, wood, plastic or metal and combination thereof.

A Large Cube (FIGS. 1, 5-9)

Figure 5:
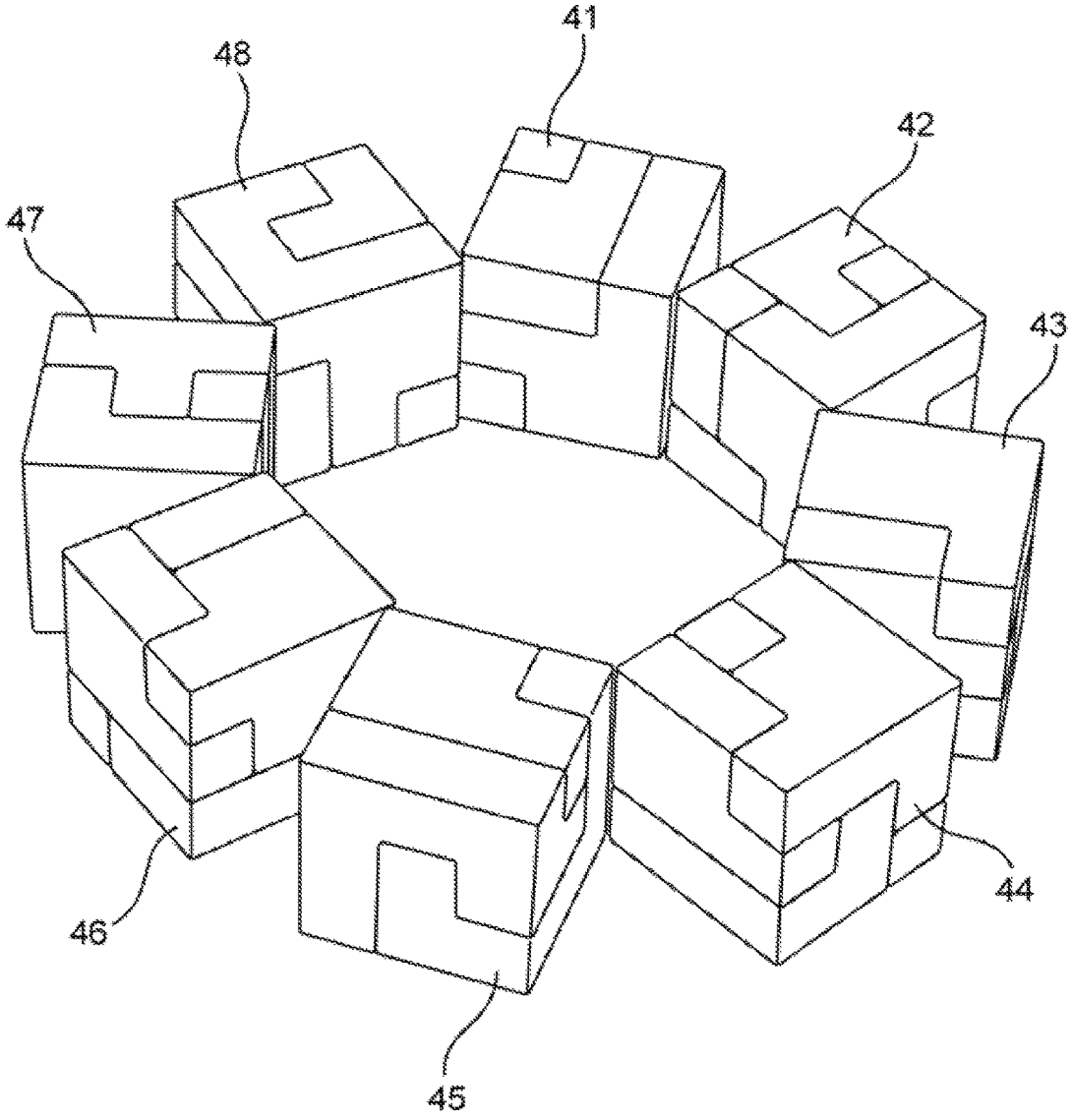
FIG. 5 depicts eight small cubes, each including three pieces.
Figure 6A:
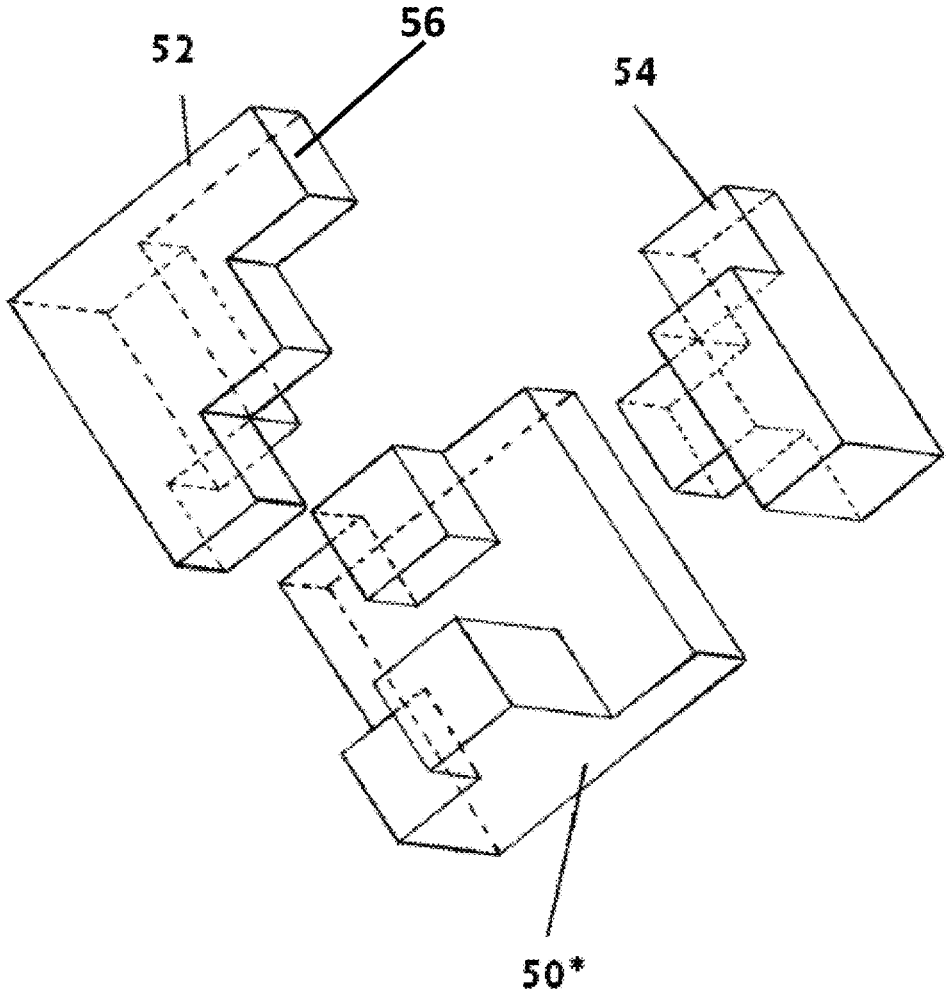
FIG. 6*a* shows a first exemplary triplet of pieces which may be combined into a small cube.
Figure 6B:
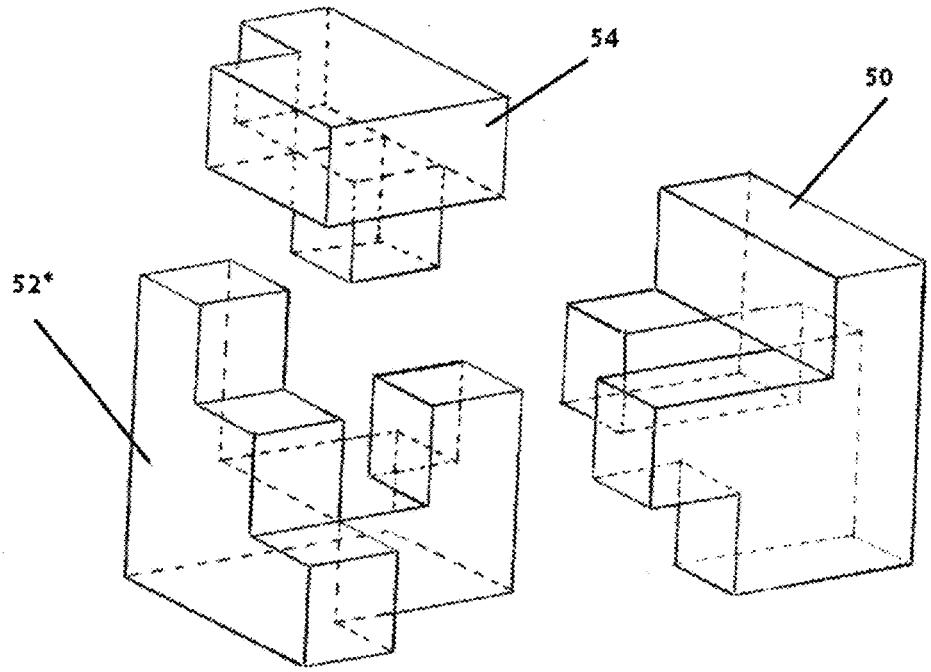
FIG. 6*b* shows a second exemplary triplet of pieces which may be combined into a small cube.
Figure 6C:
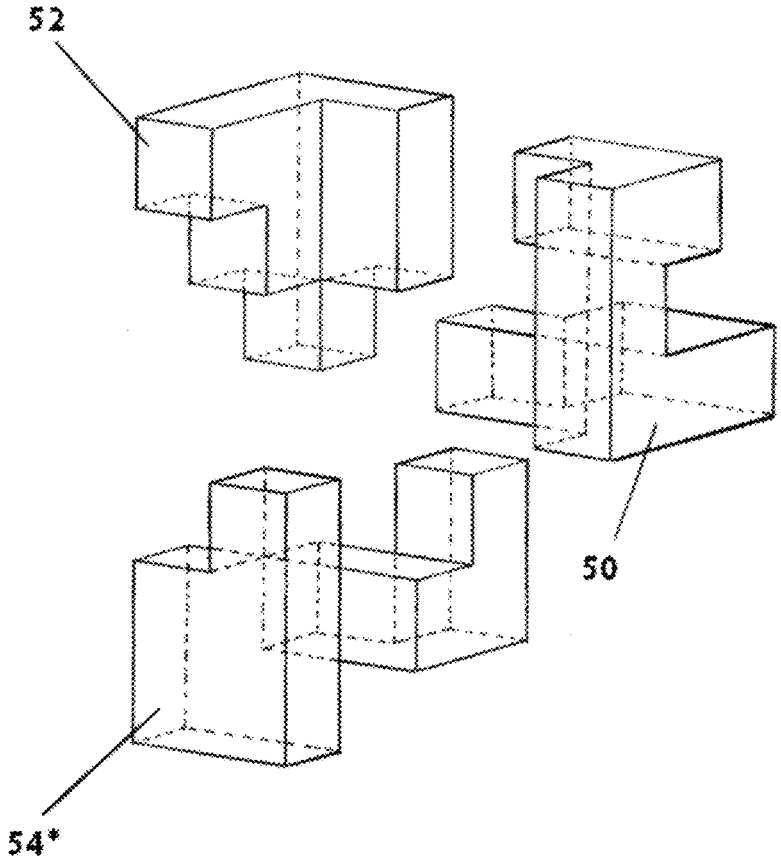
FIG. 6*c* shows a third exemplary triplet of pieces which may be combined into a small cube.

The large cube 10 consists eight small cubes, 41, 42, 43, 44, 45, 46, 47, and 48, shown separately in FIG. 5 whereas they are arranged in an octagon. Each small cube consists three pieces. FIG. 6*a* shows a first exemplary triplet of pieces 50*, 52 and 54 which may be combined into a small cube. FIG. 6*b* shows a second exemplary triplet of pieces 50, 52* and 54 which may be combined into a small cube. Finally, FIG. 6*c* shows a third exemplary triplet of pieces 50, 52 and 54* which may be combined into a small cube. FIGS. 6*a*-*c* are reproduced from Israeli Patent No. 174729 and a U.S. Pat. No. 9,162,139, both to Lando, the present inventor.

Each small cube consists 3×3×3 mini-cubes by volume, whereas each piece of FIGS. 6*a* and 6*b* exhibits at least one side of a mini-cube. For example, piece 52 has a face 56 which is a side of a mini-cube. The number of mini-cubes in piece 54*, 52* and 50* is 9, 11 and 13 respectively. The number of mini-cubes in pieces 54, 52 and 50 is 6, 8 and 10, respectively.

In the example of FIGS. 6*a* and 6*b*, a numbered piece with an asterisk is the piece having the same number without asterisk, but with an addition of an L-shape part having three mini-cubes. Pieces 50, 52 and 54 may be assembled into a cube having a L-shaped vacancy. Thus, one has to replace one of the numbered pieces 50, 52 and 54 by a piece having that same number and an asterisk.

The size of the pieces 50, 52, 54, 50*, 52* and 54* and the shape of truncated pyramids 20 and 30 are determined such that, in the packing mode, the pyramids 20 and 30 block exit of any piece out of the large cube.

The pieces 50, 52, 54, 50*, 52* and 54* may be made by plastic, wood or metal.

Referring now to the embodiment of FIGS. 7*a*, 7*b*, 8*a*, 8*b*, 9*a*, and 9*c*, the eight small cubes consist of a first group of eight pieces and a second group of 16 pieces. FIG. 7*a* presents a table 71 which lists colorful candidate pieces for a first group of pieces. FIG. 7*b* shows two tables 73 and 75 which list colorful candidate pieces for a second group of pieces. In the example of FIGS. 7*a* and 7*b*, three pieces 54* brown, 52 orange and 50 yellow are underlined to designate unelected pieces. The eight elected pieces of the first group are listed in table 81 of FIG. 8*a*. The 16 elected pieces of the second group are listed in tables 83 and 85 of FIG. 8*b*. Numerous other elections may be made in manufacturing a toy based on the pieces of FIGS. 6*a*, 6*b* and 6*c*.

In the example of FIG. 8*a*, the eight pieces of the first group include pieces 50* blue, 52* brown and 54*green which are different from each other by color, and by shape. Moreover, each of the pieces of the first group as presented in table 81 is different from another piece thereof by at least a shape or a color.

In the example of FIG. 8*b*, the 16 pieces of the second group include 50 yellow, 52 white and 54 orange which are different from each other by shape and by color. Moreover, tables 83 and 85 include seven pairs of pieces identical to each other by both shape and color. However, in tables 83 and 85, there are no triplet of pieces identical to each other by both shape and color.

In the exemplary embodiment of FIGS. 9*a* and 9*b*, each small cube includes three pieces different by shape. FIG. 9*a* presents an exemplary table 91 of 24 pieces assembled into the eight small cubes. Each small cube includes three pieces different both by shape and by color. Each small cube in tables 91 and 92 includes one piece of the first group and two pieces of the second group.

FIG. 9*b* shows another exemplary table 92 of 24 pieces assembled into the eight small cubes. Each of cubes 43 and 48 include pieces in only two colors. Yet, at least five small cubes have three pieces at three different colors. Actually, in table 92, six small cubes, all the cubes besides cubes 43 and 48, has each three pieces at three different colors.

In the example of FIGS. 6-9, there is no way to assemble a small cube using only pieces of the first group, or using only pieces of the second group.

The embodiment of FIGS. 6-9 enables a variety of play activities and brain teasing challenges for a group of players using the present game. Here is an exemplary list of possible activities:

1. Disassemble the cube to 24 pieces, mix them and reproduce the large cube.
2. In reproducing the eight small cubes, use three different colors in each small cube.
2. Use the truncated pyramids to position the cube such that one cube vertex points upwards.
3. Use the eight small cubes to build structures like a tower, train, stairs, etc.
4. Rearrange the small cubes to receive interesting patterns on faces of structures like the large cube, the tower, etc.
5. Divide the 24 pieces to groups of the same color. How many groups do you have?
6. Divide the 24 pieces to groups of the same shape. How many shape groups do you have?
7. What is the number of min-cubes in each small cube? What is the number of mini-cubes in each piece of a shape group? Could you use this information in reproducing the small cubes?
8. A foreign triplet of pieces has three pieces different from each other by both color and shape. Try to get as many foreign triplets as possible simultaneously. How many triplet have you got?
9. The following activity involves only the orange, white and yellow pieces. How many foreign triplets could you get non-simultaneously?
10. Using all colors, arrange the longest series of pieces foreign to each other that touch at least one other piece in the series. How long is the series?
11. Use all the pieces and the two pyramids such as to get the highest possible structure.

It is noted that some of the suggested activities are possible due to certain limitations on the pieces, the composition of the first and second group, and the structure of the packing members.

It is also noted that the pieces of FIGS. 6*a*, 6*b* and 6*c* may be reproduced in endless number of compositions and combinations. The way to the present disclosure of a cube puzzle limited to include exactly eight small cubes was quite long and took more than ten years. It necessitated a lot of trial, error and experience, both in the technical side and in the commercial side. The first attempt was with six different pieces which enabled three non-simultaneous cube combinations. The second trial was with nine pieces that enable integration of three cubes simultaneously, for which the present inventor got an Israeli Patent No. 174729 and a U.S. Pat. No. 9,162,139, as already mentioned in the prior art section. A third attempt was with 30 cube box which allowed integration of a 3×3×3 huge cube and extra three small cubes. Finally, the fourth trial ended with the present disclosure.

Having thus described the foregoing exemplary embodiments it will be apparent to those skilled in the art that various equivalents, alterations, modifications, and improvements thereof are possible without departing from the scope and spirit of the claims as hereafter recited. In particular, different embodiments may include combinations of features other than those described herein. Accordingly, the claims are not limited to the foregoing discussion. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A puzzle game comprising:

a) a cube packing comprising two triangular pyramids, each pyramid having three hexagonal sides rectangular to each other, such that all pyramid vertexes being truncated, and the cube packing being configured for two non-simultaneous functional modes:

A) a packing mode whereas a cube being positioned between said two triangular pyramids such that each hexagonal side of each triangular pyramid touching a face of said cube; and B) a stand mode such that:

(1) a first triangular pyramid laying on a substantially horizontal surface;

(2) a second triangular pyramid resting on said first triangular pyramid;

(3) said cube residing in said second triangular pyramid;

(4) a first vertex of said cube pointing upwards; and (5) a second vertex of said cube penetrating two pyramid truncated vertexes and pointing downwards;

b) a large cube packable within said cube packing in said packing mode, said large cube consisting of eight small cubes of a common size;

c) said eight small cubes consisting of a first group of exactly eight pieces and a second group of exactly 16 pieces, wherein each of said large cube and said small cubes having no substantial apparent vacancy within respective boundaries;

d) each small cube consisting one piece of said first group and two pieces of said second group; and e) said first group consisting eight pieces having different shapes and colors as follows:

A) a piece having a first shape and a first color; B) a piece having said first shape and a second color; C) a piece having said first shape and a third color; D) a piece having a second shape and said first color; E) a piece having said second shape and said second color; F) a piece having said second shape and said third color; G) a piece having a third shape and said first color; and H) a piece having said third shape and said second color.

2. The game of claim 1 wherein said second group consists 16 pieces having different shapes and colors as follows:

A) a single piece having a fourth shape and a fourth color;

B) two pieces having each said fourth shape and a fifth color;

C) two pieces having each said fourth shape and a sixth color;

D) two pieces having each a fifth shape and said fourth color;

E) two pieces having each said fifth shape and said fifth color;

F) a single piece having said fifth shape and said sixth color;

G) two pieces having each a sixth shape and said fourth color;

H) two pieces having each said sixth shape and said fifth color; and

I) two pieces having each said sixth shape and said sixth color.

3. The cube packing of claim 1 wherein each pyramid has at least one flat elongated surface configured for parallel interfacing with said substantially horizontal surface in said stand mode.

4. The cube packing of claim 1 wherein each pyramid has a flat surface configured for parallel interfacing with a flat surface of the other triangular pyramid in said stand mode.

5. The puzzle game of claim 1 wherein each small cube consists 3×3×3 mini-cubes by volume, whereas each piece of the first group and each piece of the second group exhibits at least one square side of a mini-cube.

6. The puzzle game of claim 5 wherein the number of mini-cubes in a piece of said first group is 9, 11 or 13.

7. The puzzle game of claim 5 wherein the number of mini-cubes in a piece of said second group is 6, 8 or 10.

* * * * *